US005428382A

United States Patent [19]

Shimosato et al.

[11] Patent Number: 5,428,382

[45] Date of Patent: Jun. 27, 1995

[54] INK JET PRINTER HEAD AND MANUFACTURING METHOD THEREFOR

[75] Inventors: Masashi Shimosato; Osamu Tsutsumida, both of Shizuoka, Japan

[73] Assignee: Tokyo Electric Co., Ltd., Tokyo, Japan

[21] Appl. No.: 28,806

[22] Filed: Mar. 10, 1993

[30] Foreign Application Priority Data

| | | | |
|---|---|---|---|
| Mar. 11, 1992 | [JP] | Japan | 4-052131 |
| Jun. 17, 1992 | [JP] | Japan | 4-157843 |
| Sep. 30, 1992 | [JP] | Japan | 4-261352 |

[51] Int. Cl.[6] ..... B41J 2/045

[52] U.S. Cl. ..... 347/71

[58] Field of Search ..... 346/1.1, 140 R; 29/25.35; 310/333, 345; B41J 2/045; 347/71, 69

[56] References Cited

U.S. PATENT DOCUMENTS

| | | | |
|---|---|---|---|
| 4,752,788 | 6/1988 | Yasuhara et al. | 346/140 R |
| 5,260,723 | 11/1993 | Naruse et al. | 346/140 R |

*Primary Examiner*—Joseph W. Hartary
*Assistant Examiner*—Alrick Bobb
*Attorney, Agent, or Firm*—Oblon, Spivak, McClelland, Maier & Neustadt

[57] ABSTRACT

An ink jet printer head including a pair of body plates bonded together; a recess portion formed on at least one of the body plates, the recess portion having a plurality of pressure chambers and a plurality of orifices respectively communicating with the pressure chambers; a pressure generating section having a plurality of driving portions formed from a piezoelectric member, the driving portions having pressure applying surfaces respectively opposed to the pressure chambers; and a resin member molded with the pressure generating section inserted therein to form at least one of the body plates. Accordingly, even when the density of arrangement of the driving portions is increased, the resin member can be surely filled into each space between the adjacent driving portions, thus realizing high-density printing and improving the productivity of the ink jet printer head.

9 Claims, 15 Drawing Sheets

INK JET PRINTER HEAD AND MANUFACTURING METHOD THEREFOR

BACKGROUND OF THE INVENTION

1. Field of the Invention

The present invention relates to an ink jet printer head having orifices for discharging an ink jet to effect recording, and also relates to a manufacturing method for such an ink jet printer head. More particularly, the present invention relates to an on-demand type ink jet printer head and a manufacturing method therefor.

2. Description of Related Art

An ink jet printer head having orifices for discharging an ink jet and depositing the same onto a printing paper to effect recording is now in practical applications as a kind of printer heads capable of effecting quick and high-density printing.

In an on-demand type ink jet printer head, a pair of body plates are bonded together, and a plurality of recesses are formed on a bonding surface of one of the body plates to define a plurality of pressure chambers. Further, a plurality of displaceable pressure applying surfaces of a pressure generating section are exposed to the pressure chambers. In such an ink jet printer head, the pressure applying surfaces of the pressure generating section are selectively vibrated by applying a driving voltage according to print image information, and an ink contained in the pressure chambers corresponding to the pressure applying surfaces thus vibrated is pressurized to be discharged as an ink jet from a plurality of orifices communicating with the pressure chambers.

FIG. 23 shows an ink jet printer head as disclosed in Japanese Patent Laid-open No. Hei 3-73348 as an example of the related art. As shown in FIG. 23, an ink jet printer head 1 is generally constructed of a pair of body plates, i.e., a channel plate 2 and a driver plate 3 bonded together. A plurality of recesses 4 are formed on a bonding surface of the channel plate 2, and a plurality of projections 5 as driving portions are formed so as to project a base 3*a* of the driver plate 3 so that end surfaces 9 of the projections 5 are respectively exposed to the recesses 4. A space 6 defined between the adjacent projections 5 is filled with an elastic material 7. Thus, a bonding surface of the driver plate 3 is formed as a flat surface. The flat bonding surface of the driver plate 3 is bonded to the bonding surface of the channel plate 2 to close the recesses 4, thereby defining a plurality of pressure chambers 8. The end surfaces 9 of the projections 5 exposed to the pressure chambers 8 serve as pressure applying surfaces for applying pressure to ink (not shown) contained in the pressure chambers 8. A driving power source 11 is connected to the pressure applying surfaces 9 and base portions 10 of the projections 5. Although not shown, an orifice plate is actually bonded to a front surface of an assembly of the plates 2 and 3.

In the ink jet printer head 1 mentioned above, the projections 5 of the driver plate 3 are selectively expanded and contracted by a driving voltage from the driving power source 11. Accordingly, the pressure applying surfaces 9 of the projections 5 are displaced to apply a pressure to the ink contained in the pressure chambers 8 of the channel plate 2, thereby discharging the ink as an ink jet from orifices of the orifice plate. To pressurize the ink in the pressure chambers 8 with high efficiency, the width of each projection 5 is set to be smaller than that of each pressure chamber 8, and the elastic material 7 is filled between the adjacent projections 5.

Further, it has been proposed that a piezoelectric ceramic is used as the material of the pressure generating section of such an ink jet printer head. As piezoelectric ceramic has a good corrosion resistance and strength, it can be utilized as a structural material for forming the pressure chambers. In this regard, it has been demanded to improve the productivity and increase the density of arrangement of the pressure chambers in forming the pressure chambers by utilizing piezoelectric ceramic.

For example, in an ink jet printer head as disclosed in Japanese Patent Laid-open No. Sho 55-17575, a comb-like pressure generating section having a plurality of driving portions arrayed in spaced relationship from each other is formed by selectively etching a surface of a piezoelectric ceramic plate, and another pressure generating section having similar driving portions is also formed by selectively etching a surface of another piezoelectric ceramic plate. Then, end surfaces of the driving portions of both the pressure generating sections are bonded together to thereby define each pressure chamber by the adjacent driving portions of both the pressure generating sections. Similarly, in an ink jet printer head as disclosed in Japanese Patent Laid-open Nos. Sho 62-56150, Sho 63-129173 and Hei 2-150355, a comb-like pressure generating section having a plurality of driving portions arrayed in spaced relationship from each other is formed by cutting (e.g., dicing) one surface or both surfaces of a piezoelectric ceramic plate, and a flat cover plate is bonded to end surfaces of the driving portions of the pressure generating section, thereby defining each pressure chamber by the adjacent driving portions of the pressure generating section.

Further, in an ink jet printer head as disclosed in Japanese Patent Laid-open Nos. Sho 60-90770 and Hei 3-10845, a comb-like pressure generating section having a plurality of driving portions arrayed in spaced relationship from each other is formed by cutting or the like of a piezoelectric ceramic plate, and an elastic vibration plate is sandwiched between the pressure generating section and a channel plate having a plurality of recesses so that end surfaces of the driving portions are respectively opposed through the vibration plate to the recesses, thereby defining each pressure chamber by each recess.

However, as each of the pressure generating sections as disclosed in each of the above cited references is formed from a piezoelectric ceramic plate, the formation of the driving portions is difficult and cracks are apt to form at the driving portions.

To solve this problem, the present assignee has proposed an improved manufacturing method for an ink jet printer head in Japanese Patent Application No. Hei 3-161172 wherein a pressure generating section having a plurality of driving portions is formed by injection molding of piezoelectric ceramic. According to this method, the pressure generating section formed of piezoelectric ceramic can be uniformly mass-produced to thereby improve the productivity.

Now, the problems in the above-mentioned related art will be described. First, in the ink jet printer head 1 as disclosed in Japanese Patent Laid-open No. Hei 3-73348, each space 6 between the adjacent projections 5 of the driver plate 3 is filled with the elastic material 7 to thereby attain high-efficiency pressurization of the ink contained in the pressure chambers 8. However, considering the demand of high-density arrangement of the orifices and the pressure chambers 8 to improve print quality, the driving portions 5 of the driver plate 3 must be very finely formed, so that it is difficult to fill the elastic material 7 in each narrow space 6 between the adjacent projections 5 arranged with a high density. Furthermore, in bonding the channel plate 2 and the driver plate 3 to each other, it is necessary to precisely position the fine recesses 4 and the fine projections 5, causing a further reduction in productivity.

On the other hand, according to the manufacturing method for the ink jet printer head in Japanese Patent Application No. Hei 3-161172 proposed by the present assignee, the pressure generating section can be easily mass-produced by injection molding of piezoelectric ceramic. Further, the present assignee has also proposed that the pressure generating section may be formed by extrusion molding of piezoelectric ceramic, so that the pressure generating section can also be easily mass-produced by extrusion molding of piezoelectric ceramic. However, as the pressure generating section is formed as an integral body by injection molding or extrusion molding, the driving portions are integrally formed with a plate-like base portion. Accordingly, when a driving voltage is applied to the driving portions of the pressure generating section, an electric field acts also to the base portion, causing deformation of the base portion. As a result, there is a possibility that the operational characteristics of the driving portions will be hindered by generating cross talk or the like. As measures for reducing the cross talk, it has purposed to thin the base portion. In this case, however, the pressure generating section is apt to be broken in injection molding or extrusion molding of piezoelectric ceramic, causing a reduction in productivity. Further, the plate-like base portion is apt to be curved in baking a molded body obtained by injection molding or extrusion molding, causing a reduction in yield.

In bonding a pair of plates constituting an ink jet printer head as mentioned above, ultrasonic bonding is desirably adopted because any portion other than the bonding surfaces of the plates is not heated and the required time for bonding is short, thus contributing to the improvement in productivity. In the case of ultrasonic bonding, fine projections called edges are formed on the bonding surfaces in general, and these edges are molten to effect the bonding of the two plates. In this case, however, the formation of the edges reduces the productivity. Accordingly, ultrasonic bonding is sometimes carried out without forming the edges. The present inventors actually prepared a pair of plates having no edges to examine the bonding performance of ultrasonic bonding without forming the edges. As a result, it was found that narrow portions of the bonding surfaces were well bonded together but wide portions of the bonding surfaces were hard to bond. Further, it was also found that the continuation of ultrasonic bonding till the completion of bonding of the wide portions caused excessive melting of the narrow portions.

SUMMARY OF THE INVENTION

It is a first object of the present invention to provide an ink jet printer head which can realize high-density printing and improve productivity.

It is a second object of the present invention to provide an ink jet printer head which can accomodate easy the positioning of the body plates in bonding them together so as to thereby improve productivity.

It is a third object of the present invention to provide an ink jet printer head which can improve the bonding performance of ultrasonic bonding to the body plates to thereby improve productivity.

It is a fourth object of the present invention to provide a manufacturing method for an ink jet printer head which can improve the operational characteristics and productivity as well as prevent the cross talk.

According to a first aspect of the present invention, there is provided an ink jet printer head comprising a pair of first and second body plates having bonding surfaces bonded to each other; a recess portion formed on the bonding surface of at least one of the first and second body plates, the recess portion comprising an ink supply passage, a plurality of pressure chambers communicating with the ink supply passage, and a plurality of orifices respectively communicating with the pressure chambers; a pressure generating section having a plurality of driving portions formed from a piezoelectric member, the driving portions having pressure applying surfaces respectively opposed to the pressure chambers; and a resin member molded with the pressure generating section inserted therein to form at least one of the first and second body plates. Accordingly, even when the density of arrangement of the driving portions of the pressure generating section is increased, the resin member can be surely filled into each space between the adjacent driving portions, thus realizing high-density printing and improving productivity.

According to a second aspect of the present invention, the recess portion is formed on the bonding surface of the first body plate; the pressure generating section and the resin member are provided in the first body plate so as to expose the driving portions of the pressure generating section to the pressure chambers of the recess portion; and the bonding surface of the second body plate flat. Accordingly, the positioning of the two body plates can be easily effected in bonding them together to thereby improve productivity.

According to a third aspect of the present invention, the ink jet printer head mentioned above further comprises a second recess portion formed on the bonding surface of at least one of the first and second body plates so as to provide a bonding surface with a uniform width, wherein the bonding surfaces of the first and second body plates are bonded to each other by ultrasonic bonding. Accordingly, the bonding surfaces of the two body plates can be uniformly molten by ultrasonic bonding, thereby improving the bonding performance of ultrasonic bonding to the two body plates.

According to a fourth aspect of the present invention, a manufacturing method for an ink jet printer head comprising a comb-like pressure generating section having a plurality of driving portions each polarized in a predetermined direction thereof, a plurality of pressure chambers respectively opposed to the driving portions of the pressure generating section, an ink supply passage communicating with the pressure chambers for supplying an ink to the pressure chambers, and a plurality of orifices respectively communicating with the pressure chambers for discharging the ink contained in the pressure chambers, whereby the driving portions are deformed to pressurize the ink contained in the pressure chambers and discharge the ink from the orifices; the manufacturing method comprising the first step of forming a base member by molding of piezoelectric ceramic, the base member comprising a base portion and the driving portions formed on the base portion; the second step of bonding one surface of each of the driving portions of the base member to a non-piezoelectric substrate; and the third step of cutting the base portion of the base member away from the driving portions on the non-piezoelectric substrate to form the pressure generating section. Accordingly, deformation of the non-piezoelectric substrate due to a driving voltage to be applied to the driving portions can be prevented to thereby improve the operational characteristics of the driving portions and prevent the generation of cross talk. Further, even when the base portion of the base member is deformed in baking a molded body obtained by injection molding or extrusion molding of piezoelectric ceramic, form accuracy of the pressure generating section can be improved by carrying out sizing of the base member in bonding to the non-piezoelectric substrate and cutting off the base portion, thereby improving the operational characteristics and productivity.

According to a fifth aspect of the present invention, there is provided a manufacturing method for an ink jet printer head comprising a comb-like pressure generating section having a plurality of driving portions each polarized in a predetermined direction thereof, a plurality of pressure chambers respectively opposed to the driving portions of the pressure generating section, an ink supply passage communicating with the pressure chambers for supplying an ink to the pressure chambers, and a plurality of orifices respectively communicating with the pressure chambers for discharging the ink contained in the pressure chambers, whereby the driving portions are deformed to pressurize the ink contained in the pressure chambers and discharge the ink from the orifices; the manufacturing method comprising the first step of forming a base member by molding of piezoelectric ceramic, the base member comprising a thin plate-like base portion, the driving portions formed on an upper surface of the base portion, and a pair of reinforcing portions connecting the driving portions at opposite ends thereof; the second step of bonding a lower surface of the base portion of the base member to a non-piezoelectric substrate; and the third step of cutting the reinforcing portions of the base member away from the driving portions on the non-piezoelectric substrate to form the pressure generating section. Accordingly, the strength of the base member is ensured by the reinforcing portions to prevent deformation of the base member. Further, since the base portion of the base member has a small thickness, the cross talk between the driving portions and the base portion upon driving the driving portions can be greatly reduced.

DESCRIPTION OF THE PREFERRED EMBODIMENTS

Figure 1:
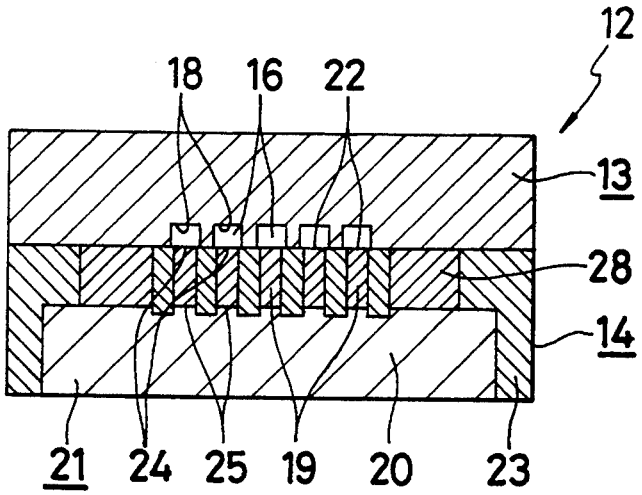
FIG. 1 is a vertical sectional view of an ink jet printer head according to a first preferred embodiment of the present invention.
Figure 5:
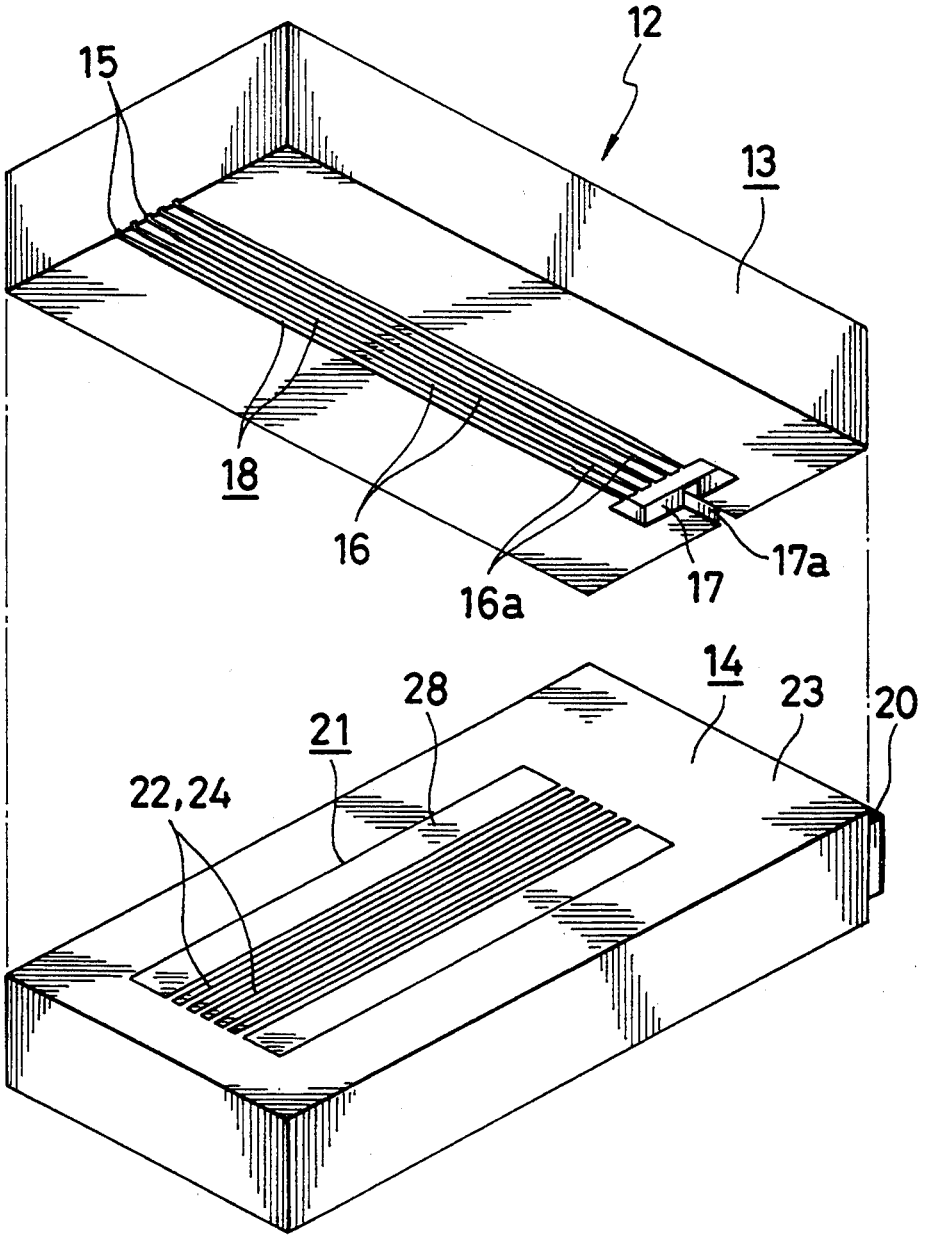
FIG. 5 is a perspective view illustrating the fourth step of the manufacturing method according to the first preferred embodiment.
Figure 6:
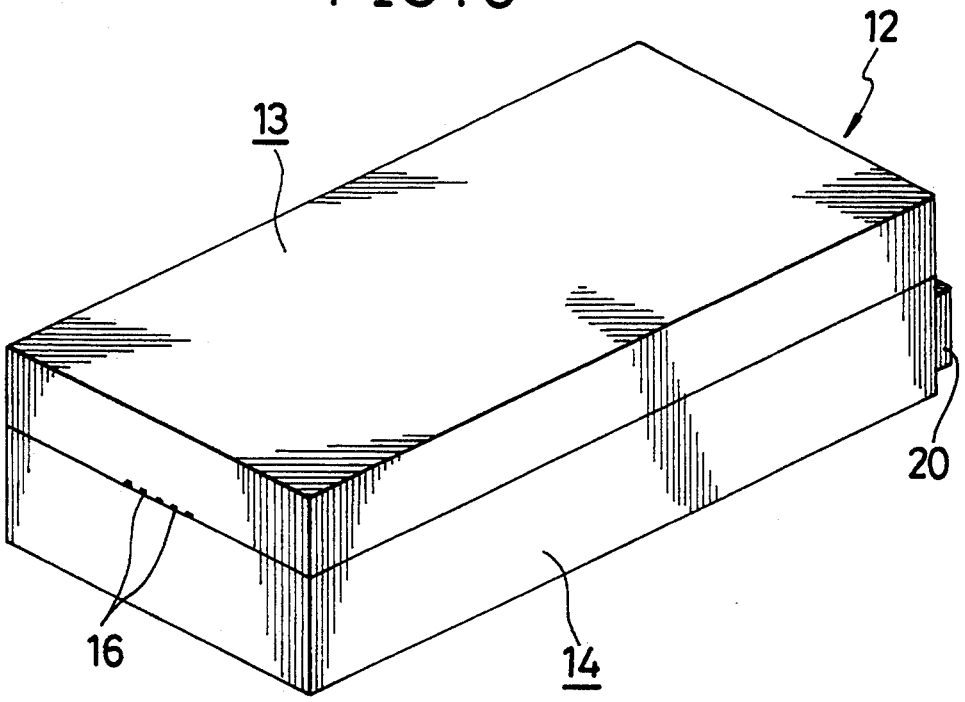
FIG. 6 is a perspective view of the ink jet printer head obtained by the manufacturing method according to the first preferred embodiment.

A first preferred embodiment of the present invention will be described with reference to FIGS. 1 to 6. The first preferred embodiment corresponds to the species as defined in claims 1 to 3. Referring to FIGS. 1, 5 and 6, reference numeral 12 generally designates an ink jet printer head according to the first preferred embodiment. The ink jet printer head 12 is generally constructed of a pair of body plates, i.e., a channel plate 13 and a driver plate 14 bonded together. An elongated recess portion 18 is formed on a bonding surface of the channel plate 13. The elongated recess portion 18 is comprised of a plurality of orifices 15 arranged in parallel, a plurality of pressure chambers 16 arranged in parallel, a plurality of ink inlet passages 16*a* arranged in parallel, an ink reservoir 17, and an ink supply passage 17*a*, these communicating with each other. On the other hand, the driver plate 14 is generally constructed of an insulating substrate 20, a piezoelectric member 28 bonded to an upper surface of the insulating substrate 20, and a resin member 23 molded with an assembly of the insulating substrate 20 and the piezoelectric member 28 inserted therein. The piezoelectric member 28 is formed of piezoelectric ceramic, and it has a plurality of elongated driving portions 19 arranged in parallel to each other and projecting from the upper surface of the insulating substrate 20, thus forming a pressure generating section 21. A plurality of upper surfaces 22 of the driving portions 19 are respectively opposed to the pressure chambers 16 of the channel plate 13. Thus, the channel plate 13 and the driver plate 14 are bonded together so that the upper surfaces 22 of the driving portions 19 of the piezoelectric member 28 are respectively opposed to the pressure chambers 16 of the channel plate 13 so as to form a plurality of pressure applying surfaces of the pressure generating section 21. Further, a plurality of individual electrodes 24 are respectively formed on the upper surfaces 22 of the driving portions 19 of the piezoelectric member 28, and a plurality of common electrodes 25 are formed on the lower surfaces of the driving portions 19 of the piezoelectric member 28.

In operation, when a driving voltage is selectively applied between the electrodes 24 and 25, the driving portions 19 of the piezoelectric member 28 of the driver plate 14 are selectively expanded and contracted in a projecting direction thereof, that is, in the vertical direction as viewed in FIG. 1. As a result, the upper surfaces 22 of the driving portions 19 of the piezoelectric member 28 are selectively displaced to thereby apply pressure to an ink (not shown) contained in the corresponding pressure chambers 16 of the channel plate 13 and discharge the pressurized ink from the corresponding orifices 15. At this time, the resin member 23 of the driver plate 14 is deformed together with the driving portions 19 expanded and contracted. As the expansion and contraction of the driving portions 19 of the piezoelectric member 28 formed of piezoelectric ceramic such as PZT (Lead Zirco Titanate) are minute such as about 1.0 $\mu$m and quick, deformation of the flexible resin member 23 is readily effected. The application of the pressure to the ink contained in the pressure chambers 16 may be effected by applying a driving voltage to the pressure generating section 21 and thereby quickly projecting the driving portions 19 into the pressure chambers 16, or by previously retracting the driving portions 19 by the application of the driving voltage and stopping the application of the driving voltage to thereby quickly return the driving portions 19 to their initial condition.

Figure 2:
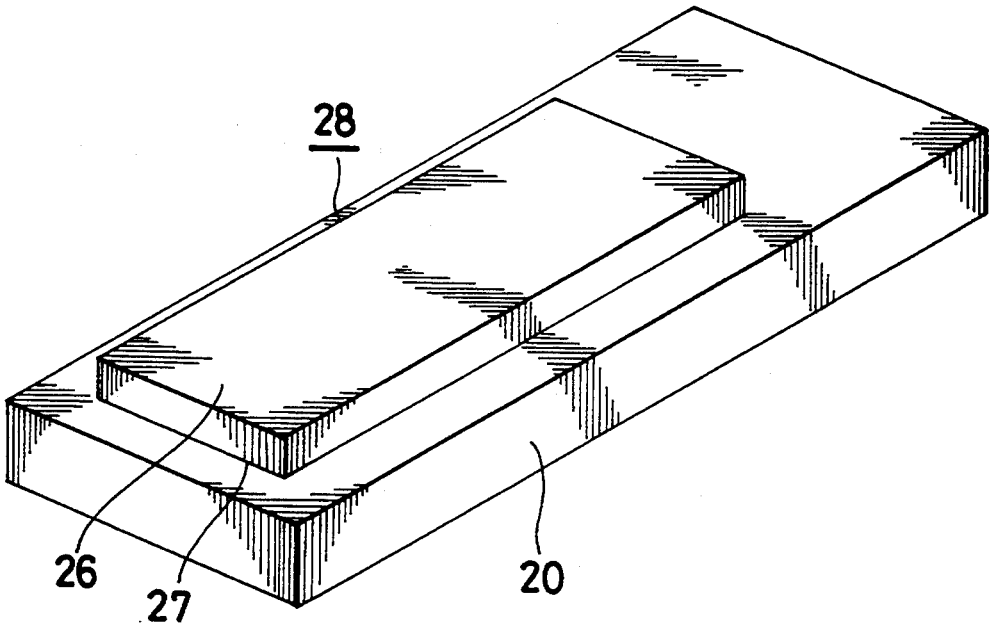
FIG. 2 is a perspective view illustrating the first step of a manufacturing method for the ink jet printer head according to the first preferred embodiment.

A manufacturing method for the ink jet printer head 12 will be described with reference to FIGS. 2 to 6. First, metal films 26 and 27 such as aluminum films are formed as conductive films on the upper and lower surfaces of the piezoelectric member 28 formed of piezoelectric ceramic such as PZT, and the piezoelectric member 28 is then polarized in the plate thickness direction thereof. Then, as shown in FIG. 2, the piezoelectric member 28 is electrically bonded to the upper surface of the insulating substrate 20 formed of glass or ceramic by using an anaerobic adhesive under pressure. Various bonding methods for the piezoelectric member 28 to the insulating substrate 20 may be adopted. For example, a conductive adhesive, metal solder or conductive paste may be used. In this case, the metal film 27 becomes unnecessary. The plate thickness of the piezoelectric member 28 is set to about 0.05 to 1.0 mm, preferably 0.1 to 0.5 mm, and the length of the piezoelectric member 28 is set to about 1.0 to 30 mm.

Figure 3:
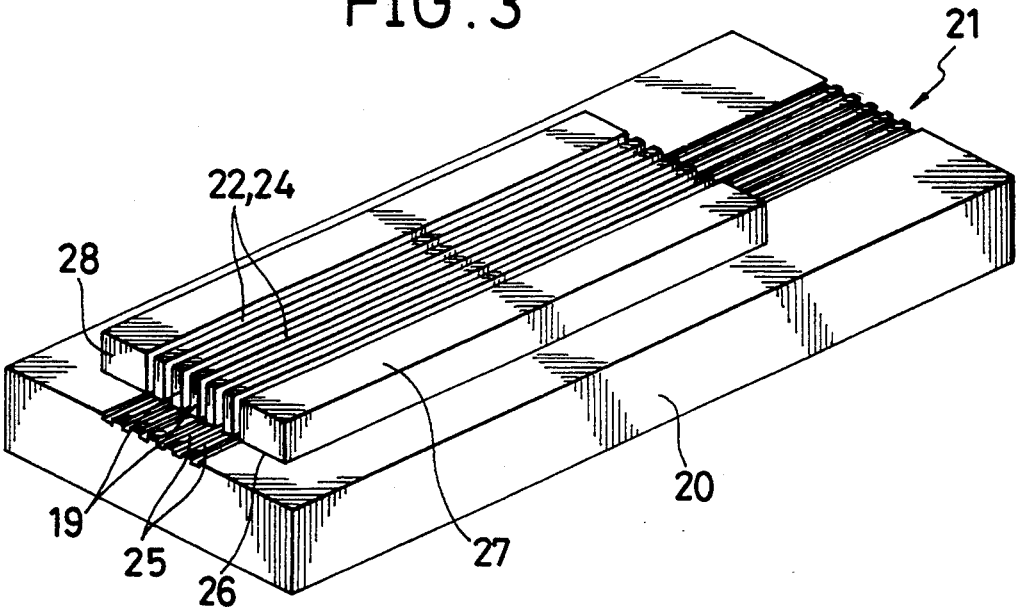
FIG. 3 is a perspective view illustrating the second step of the manufacturing method according to the first preferred embodiment.

Then, as shown in FIG. 3, the piezoelectric member 28 bonded to the insulating substrate 20 is cut by dicing to form the parallel driving portions 19 extending in a longitudinal direction of the piezoelectric member 28, thus forming the pressure generating section 21. The width of each driving portion 19 thus separated is set to 0.05 to 1.0 mm. To ensure the separation of the driving portions 19, the dicing is performed to a depth just greater than the plate thickness of the piezoelectric member 28. Thus, the piezoelectric member 28 is cut together with the metal films 26 and 27 formed on the upper and lower surfaces thereof, thereby forming the electrodes 24 and 25 from the metal films 26 and 27, respectively. At this time, the electrodes 24 and 25 may be extended to a rear end portion of the insulating substrate 20 by using a printed wiring or the like to be formed by a known thin film technique.

Although the dicing is applied to the both the piezoelectric member 28 and the insulating substrate 20 in this preferred embodiment, the dicing applied to the insulating substrate 20 may be omitted provided that the piezoelectric member 28 can be surely cut by dicing to form the independent driving portions 19. Further, instead of the pressure generating section 21, a pressure generating section (not shown) having the same form as that of the pressure generating section 21 may be integrally formed by injection molding of piezoelectric ceramic.

Figure 4:
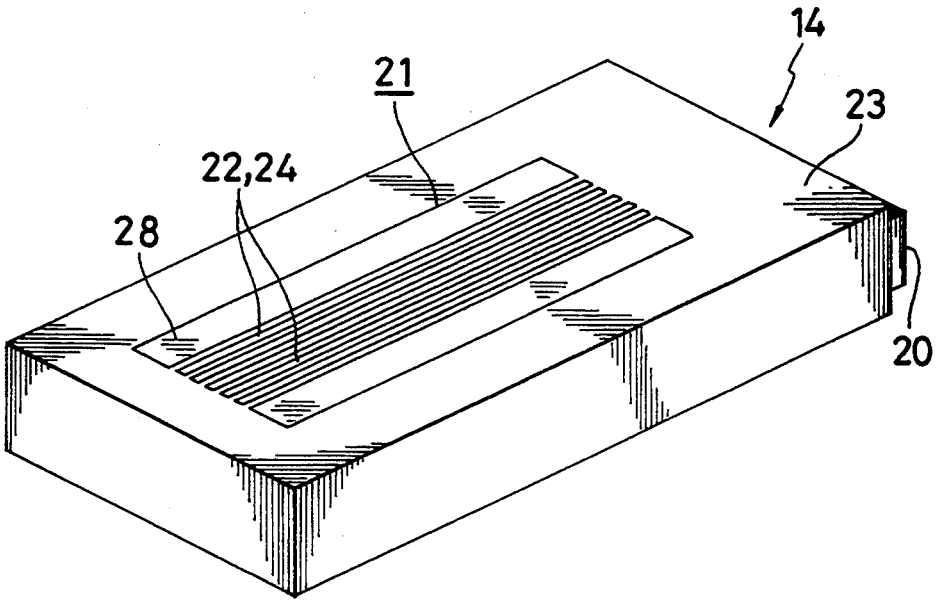
FIG. 4 is a perspective view illustrating the third step of the manufacturing method according to the first preferred embodiment.

Then, as shown in FIG. 4, the pressure generating section 21 thus formed is inserted into the resin member 23 to thereby form the driver plate 14 so that the upper surfaces 22 of the driving portions 19 of the piezoelectric member 28 are exposed to the upper surface of the driver plate 14. In this insert operation, the rear end portion of the insulating substrate 20 is projected from the rear end surface of the resin member 23, so that a driving source (not shown) can be connected through a FPC (Flexible Printed Circuit) or the like to the electrodes 24 and 25 extended to the rear end portion of the insulating substrate 20.

While the upper surfaces 22 of the driving portions 19 of the piezoelectric member 23 constituting the pressure generating section 21 are exposed to the upper surface of the resin member 23 of the driver plate 14 in the above preferred embodiment, the upper surfaces 22 of the driving portions 19 may be disposed under a thin film (not shown) of the resin member 23, or a dedicated protective film (not shown) may be formed on the upper surfaces 22 of the driving portions 19 exposed, whereby possible corrosion of the individual electrodes 24 by the ink can be prevented. The material of the resin member 23 is selected with consideration of moldability, corrosion resistance to the ink, bonding ability to the channel plate 13, modulus of elasticity, hardness, etc. For example, the material of the resin member 23 may be selected from PPS (polyphenylenesulfide), PES (polyethersulfone), PSF (polysulfone), PPO (polyphenylene oxide), PPE (polyphenylene ether), PEEK (polyetheretherketone), PET (polyethyleneterephthalate), PBT (polybutyleneterephthalate), PMP (polymethylpentene), etc. The molding temperature of the resin member 23 is set to be preferably lower than the Curie point of the driving portions 19 of the piezoelectric member 28, so as to maintain the polarization of the driving portions 19. However, the driving portions 19 may be easily polarized by supplying a current to the electrodes 24 and 25 even after molding the resin member 23. Accordingly, it is not essential to set the molding temperature of the resin member 23 to be lower than the Curie point of the driving portions 19.

On the other hand, as shown in FIG. 5, the channel plate 13 having the recess portion 18 consisting of the orifices 15, the pressure chambers 16, the ink inlet passages 16*a*, the ink reservoir 17 and the ink supply passage 17*a* is formed by injection molding of resin, ceramic, etc. Then, the channel plate 13 is bonded to the driver plate 14 to obtain the ink jet printer head 12 having a front surface from which the orifices 15 open to the outside as shown in FIG. 6. A method of bonding the channel plate 13 to the driver plate 14 is selected from thermocompression bonding, solvent bonding, ultrasonic bonding, etc. In particular, the ultrasonic bonding is effective because any portion of the body plates 13 and 14 other than the bonding surfaces is not heated. In this ink jet printer head 12, it is necessary from the viewpoint of its structure to precisely position the driving portions 19 of the piezoelectric member 28 of the driver plate 14 and the pressure chambers 16 of the channel plate 13. To meet this necessity, the bonding surfaces of the driver plate 14 and the channel plate 13 may be formed with fine conical projections to be heated, thereby eliminating slip of the bonding surfaces upon bonding.

In the driver plate 14, each space between the adjacent driving portions 19 of the piezoelectric member 28 is filled with the flexible resin member 23 so that the bonding surface of the driver plate 14 may be made flat. Accordingly, the pressure chambers 16 of the channel plate 13 are well closed by the bonding surface of the driver plate 14, thereby pressurizing the ink contained in the pressure chambers 16 with high efficiency. Even when the density of arrangement of the driving portions 19 of the piezoelectric member 28 as well as the orifices 15 and the pressure chambers 16 of the channel plate 13 is increased, so as to improve print quality, productivity can be greatly improved since the resin member 23 is molded with the insert of the pressure generating section 21 to be surely filled into each space between the adjacent driving portions 19 of the piezoelectric member 28.

In the formation of the recess portion 18 of the channel plate 13, the width and the depth of each orifice 15 are both set to about 0.02 to 0.08 mm, and the width and the depth of each pressure chamber 16 are respectively set to about 0.05 to 1.0 mm and about 0.02 to 0.2 mm. The recess portion 18 having such dimensions can be easily formed by injection molding of resin. The width and the length of each pressure chamber 16 of the channel plate 13 are set to be equal to or slightly larger than the width and the length of the upper surface 22 of each driving portion 19 of the driver plate 14. The discharge performance of the ink jet to be discharged from each orifice 15 can be adjusted by adjusting the lengths of each driving portion 19 and each pressure chamber 16.

Similar to the driver plate 14, the material of the channel plate 13 is selected with consideration of moldability, corrosion resistance to the ink, bonding ability to the driver plate 14, modulus of elasticity, hardness, etc. While the resin member 23 of the driver plate 14 is required to have a flexibility, so as to be readily deformed with the driving portions 19 of the piezoelectric member 28, the material of the channel plate 13 is required to have a hardness, so as to prevent pressure loss. However, considering the mutual bonding ability, the expansion due to a temperature change and the productivity, it is preferable that the channel plate 13 and the driver plate 14 are formed of the same material. In this regard, the channel plate 13 may be formed of a hard composite material obtained by mixing a glass filler in the same flexible resin as that of the resin member 23 of the driver plate 14. The plate thickness of the channel plate 13 is set to about 0.5 to 5.0 mm. Further, it is not essential to use a common material for the channel plate 13 and the driver plate 14 provided that the channel plate 13 can be surely bonded to the driver plate 14 with heat.

To expel bubbles (not shown) generated in the ink in a preferred manner, it is preferable that the plates 13 and 14 are to be formed of a material having a good characteristic to with respect the ink. In general, the wettability of resin is lower than that of glass, metal and ceramic, but can be easily improved by a known technique such as plasma processing or graft polymerization. In contrast, the front surfaces of the plates 13 and 14 from which the orifices 15 open are required to have a low wettability, so as to properly discharge the ink jet. Accordingly, in the case of carrying out the processing for improving the wettability as mentioned above, it is preferable to mask the front surfaces of the plates 13 and 14 before the processing or to polish the front surfaces of the plates 13 and 14 after the processing. Further, the front surfaces of the plates 13 and 14 may be treated by plasma processing in an atmosphere of fluorine as known in the prior art, so as to further lower the wettability to the ink.

In this preferred embodiment, the pressure generating section 21 is provided in the driver plate 14, and the recess portion 18 is formed on the channel plate 13. However, such a structure is merely illustrative, and various modifications may be made according to the present invention. For example, a pair of recess portions each similar to the recess portion 18 may be respectively formed on a pair of body plates, or a pair of pressure generating sections each similar to the pressure generating section 21 may be respectively provided in a pair of body plates.

Figure 7:
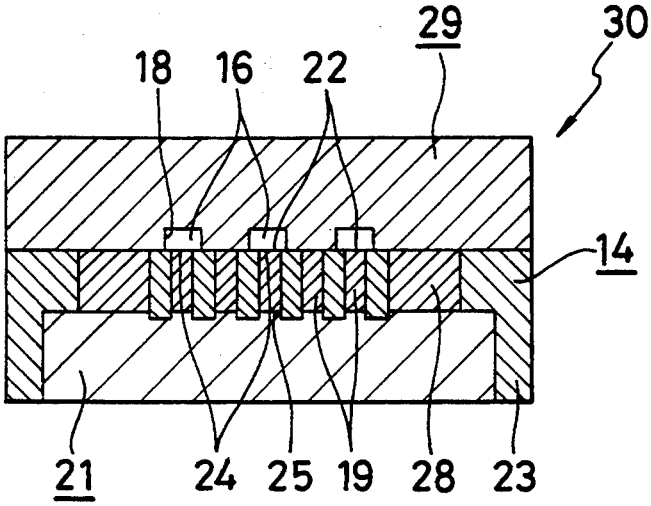
FIG. 7 is a vertical sectional view of an ink jet printer head according to a second preferred embodiment of the present invention.

A second preferred embodiment of the present invention will be described with reference to FIG. 7, in which the same parts as those in the first preferred embodiment are designated by the same reference numerals and the explanation thereof will be omitted. Referring to FIG. 7, reference numeral 30 generally designates an ink jet printer head according to the second preferred embodiment. In the ink jet printer head 30, some of the driving portions 19 are opposed every other line to the pressure chambers 16 of a channel plate 29, and the others are not opposed to the pressure chambers 16. That is, the driving portions 19 not opposed to the pressure chambers 16 serve as supports for the channel plate 29.

With this construction, the channel plate 29 is supported by not only the flexible resin member 23 but also the rigid driving portions 19 of the piezoelectric member 28. Accordingly, deformation of the channel plate 29 due to aged deterioration can be prevented.

A third preferred embodiment of the present invention will be described with reference to FIGS. 8 to 11, in which the same parts as those in the first preferred embodiment are designated by the same reference numerals and the explanation thereof will be omitted. In the first and second preferred embodiments, it is necessary to precisely position the pressure chambers and the driving portions in bonding the channel plate and the driver plate to each other. To the contrary, in the third preferred embodiment, such precise positioning of the pressure chambers and the driving portions in bonding both the plates is not necessary.

Figure 8:
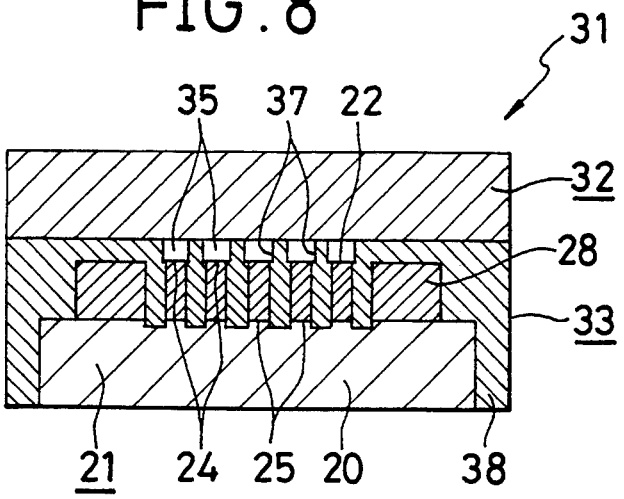
FIG. 8 is a vertical sectional view of an ink jet printer head according to a third preferred embodiment of the present invention.
Figure 10:
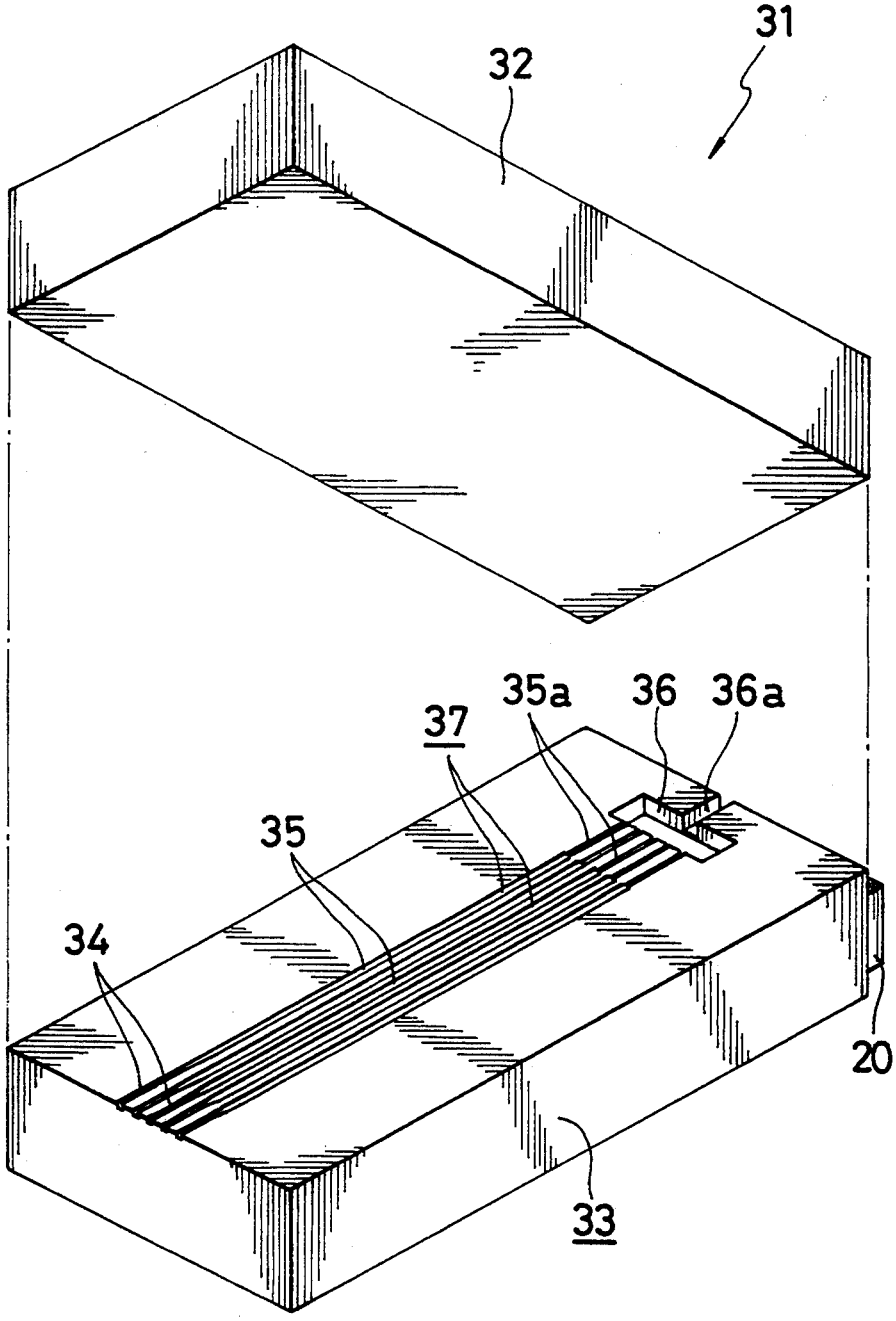
FIG. 10 is a perspective view illustrating the fourth step of the manufacturing method according to the third preferred embodiment.
Figure 11:
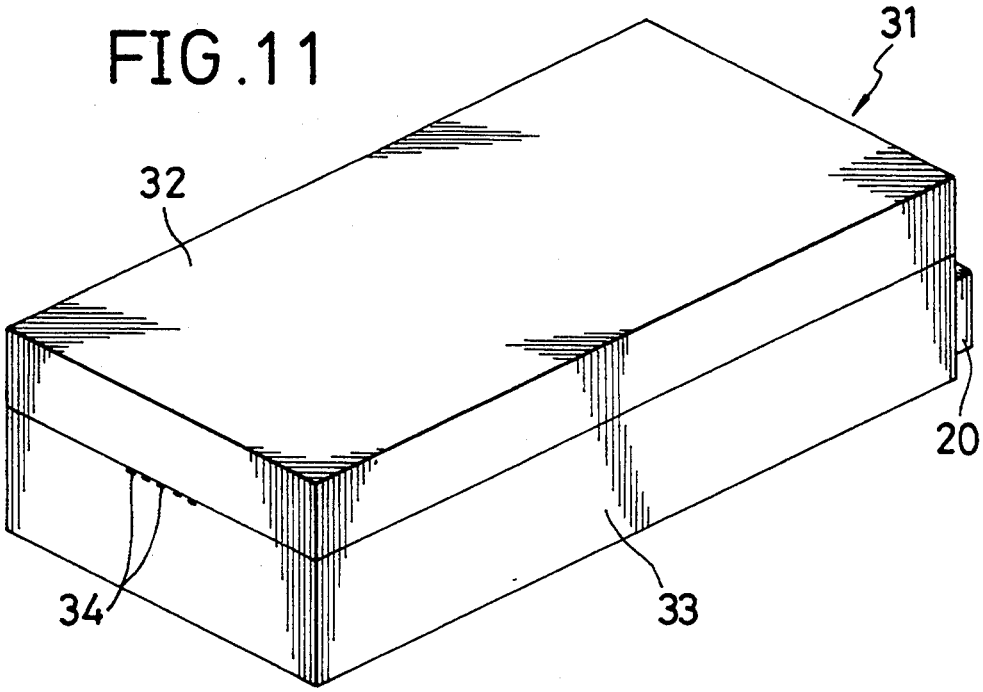
FIG. 11 is a perspective view of the ink jet printer head obtained by the manufacturing method according to the third preferred embodiment.

Referring to FIGS. 8, 10 and 11, reference numeral 31 generally designates an ink jet printer head according to the third preferred embodiment. The ink jet printer head 31 is generally constructed of a pair of body plates, i.e., a cover plate 32 and a main plate 33 bonded together. The cover plate 32 is a simple flat plate. On the other hand, the main plate 33 is generally constructed of an insulating substrate 20, a piezoelectric member 28 bonded to the insulating substrate 20, and a resin member 38 molded with an assembly of the insulating substrate 20 and the piezoelectric member 28 inserted therein. Similar to the first preferred embodiment, the piezoelectric member 28 is formed with a plurality of driving portions 19 projecting from the upper surface of the insulating substrate 20, thus forming a pressure generating section 21. Further, the resin member 38 is formed with a recess portion 37 consisting of a plurality of orifices 34, a plurality of pressure chambers 35, a plurality of ink inlet passages 35*a*, an ink reservoir 36 and an ink supply passage 36*a*, these communicating with each other. The recess portion 37 is formed on a bonding surface of the main plate 33, that is, an upper surface of the resin member 38 as viewed in FIG. 8. The upper surfaces 22 of the driving portions 19 of the piezoelectric member 28 are exposed to the pressure chambers 35 formed on the upper surface of the resin member 38. Further, similar to the first preferred embodiment, a plurality of electrodes 24 and 25 are respectively formed on the upper and lower surfaces of the driving portions 19.

In operation, when a driving voltage is selectively applied between the electrodes 24 and 25, the driving portions 19 of the piezoelectric member 28 of the main plate 33 are selectively expanded and contracted in a projecting direction thereof. As a result, the upper surfaces 22 of the driving portions 19 of the piezoelectric member 28 are selectively displaced to thereby apply a pressure to an ink (not shown) contained in the corresponding pressure chambers 35 of the main plate 33 and discharge the pressurized ink from the corresponding orifices 34.

A manufacturing method for the ink jet printer head 31 will be described with reference to FIGS. 9 to 11. Similar to the first preferred embodiment, the piezoelectric member 28 having metal films on the upper and lower surfaces thereof as the electrodes 24 and 25 is polarized in a plate thickness direction thereof, and the piezoelectric member 28 is then bonded to the upper surface of the insulating substrate 20. Then, the piezoelectric member 28 bonded to the insulating substrate 20 is cut by dicing to form the driving portions 19, thus forming the pressure generating section 21.

Figure 9:
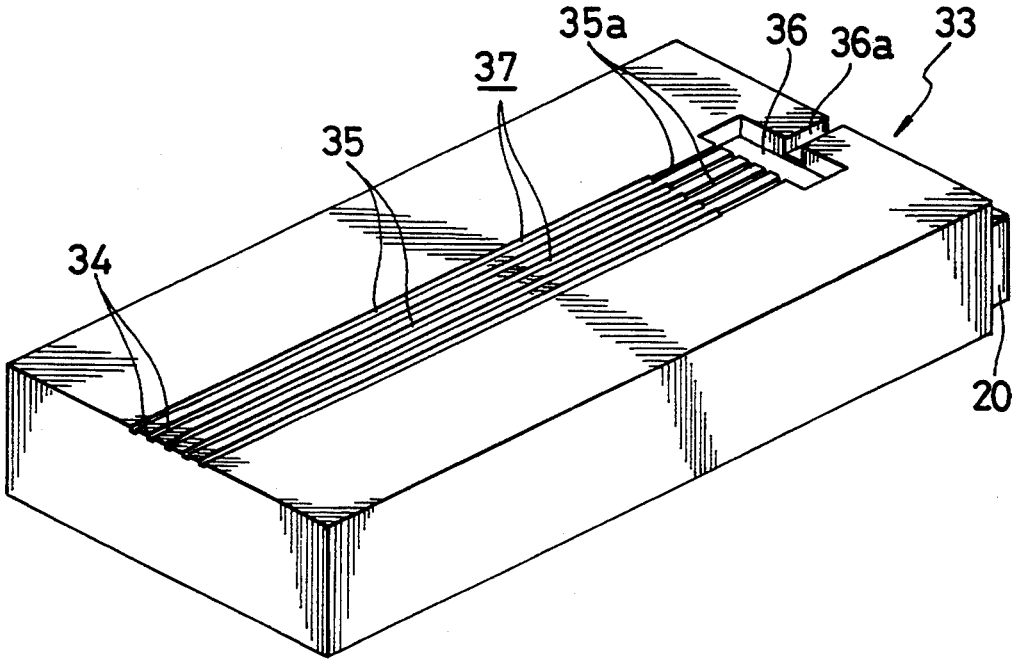
FIG. 9 is a perspective view illustrating the third step of a manufacturing method for the ink jet printer head according to the third preferred embodiment.

Then, the pressure generating section 21 is inserted into the resin member 38 and injection molding is performed to form the recess portion 37 on the upper surface of the resin member 38 as shown in FIG. 9, thus forming the main plate 33 wherein the upper surfaces 22 of the driving portions 19 of the piezoelectric member 28 are exposed to the pressure chambers 35 of the recess portion 37. The material of the resin member 38 constituting the main plate 33 is selected in consideration of moldability, corrosion resistance to the ink, bonding ability to the cover plate 32, modulus of elasticity, hardness, etc. In the ink jet printer head 12 according to the first preferred embodiment, the flexibility of the resin member 23 is important because it is a primary object to fill the resin member 23 into each space between the adjacent driving portions 19. To the contrary, in the ink jet printer head 31 according to the third preferred embodiment, it is necessary to balance the elasticity and the hardness of the resin member 38 because it is another object to form the pressure chambers 35 in addition to the above primary object. In view of this necessity, a very flexible resin such as PET, PBT or PMP is not preferable as the material of the resin member 38, but a relatively hard resin such as PPS, PES, PSF, PPO, PPE or PEEK may be preferably employed as the material of the resin member 38. However, since the modulus of elasticity and the hardness of such resin can be suitably adjusted by mixing a glass filler, various kinds of resin may be employed as the material of the resin member 38.

Then, as shown in FIG. 10, the cover plate 32 such as a glass substrate or a ceramic substrate is bonded to the main plate 33 to obtain the ink jet printer head 31 having a front surface from which the orifices 34 open to the outside as shown in FIG. 11.

With the construction of the ink jet printer head 31, each space between the adjacent driving portions 19 of the piezoelectric member 28 is filled with the flexible resin member 38, so that the ink contained in the pressure chambers 35 can be pressurized with a high efficiency. Even when the density of arrangement of the driving portions 19 of the piezoelectric member 28 as well as the orifices 34 and the pressure chambers 35 is increased, so as to improve print quality, the productivity can be greatly improved since the resin member 38 is molded with the pressure generating section 21 inserted therein to be surely filled into each space between the adjacent driving portions 19 of the piezoelectric member 28.

Further, both the pressure generating section 21 inclusive of the driving portions 19 and the recess portion 37 inclusive of the pressure chambers 35 are formed in the main plate 33, and the cover plate 32 to be bonded to the main plate 33 is formed as a simple flat plate. Therefore, it is unnecessary to position the driving portions 19 and the pressure chambers 35 in bonding the cover plate 32 to the main plate 33. Thus, the bonding operation can be easily carried out to thereby greatly improve the productivity. However, since the front surface of the ink jet printer head 31 from which the orifices 34 open must be flat, it is necessary to position both the plates 32 and 33 so that the front surfaces of both the plates 32 and 33 bonded together may become flush. However, the front surfaces of both the plates 32 and 33 bonded together may be polished to obtain the flat front surface of the ink jet printer head 31. Accordingly, the accuracy of positioning of both the plates 32 and 33 may be reduced to thereby improve productivity.

Also in the third preferred embodiment, ultrasonic bonding may be desirably adopted to bond both the plates 32 and 33 because any portion other than the bonding surfaces of the plates 32 and 33 is not heated, thereby shortening a required time for bonding and contributing to the improvement in productivity.

A fourth preferred embodiment of the present invention will be described with reference to FIGS. 12 and 13, in Which the same parts as those in the third preferred embodiment are designated by the same reference numerals and an explanation thereof will be omitted. In the fourth preferred embodiment, ultrasonic bonding is more preferably adopted to bond a pair of body plates similar to the body plates 32 and 33 mentioned in the third preferred embodiment.

Figure 12:
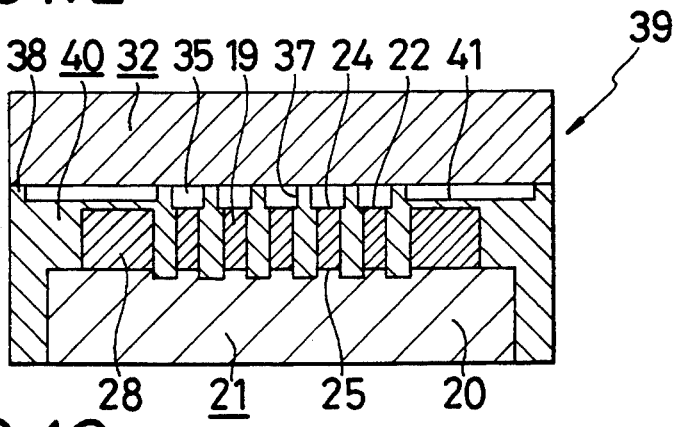
FIG. 12 is a vertical sectional view of an ink jet printer head according to a fourth preferred embodiment of the present invention.
Figure 13:
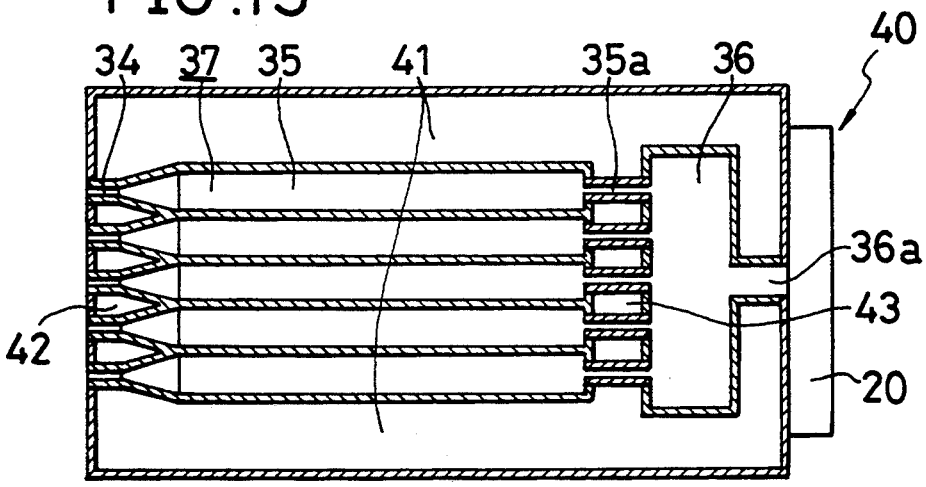
FIG. 13 is a plan view of a main plate shown in FIG. 12.
Figure 14A:
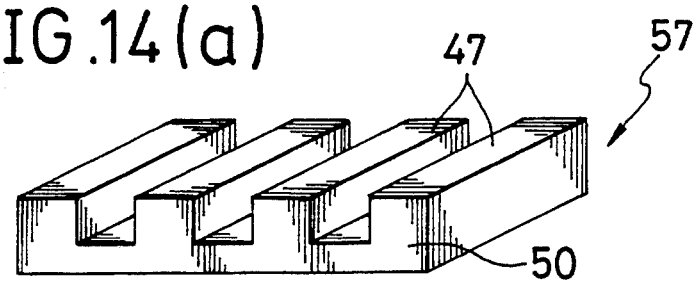
FIGS. 14(*a*) to 14(*d*) are perspective views illustrating a manufacturing method for a pressure generating section of an ink jet printer head according to a fifth preferred embodiment of the present invention.
Figure 14B:
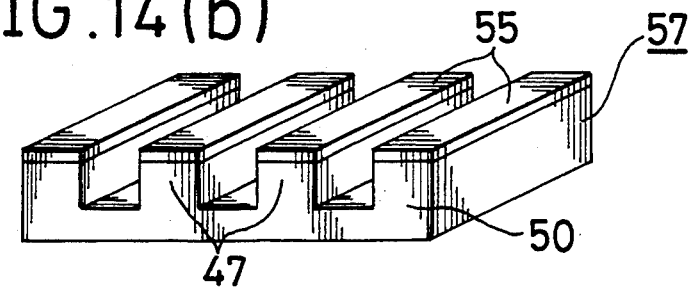
Figure 14C:
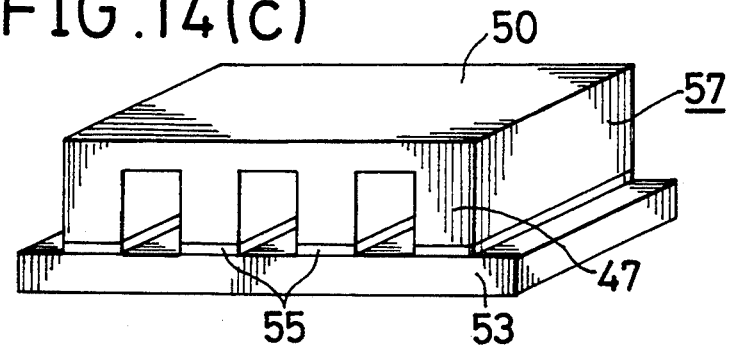
Figure 14D:
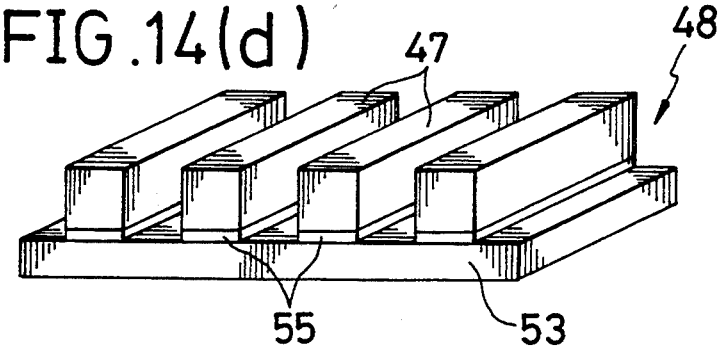

Referring to FIGS. 12 and 13, reference numeral 39 generally designates an ink jet printer head according to the fourth preferred embodiment. The ink jet printer head 39 is generally constructed of a pair of body plates, i.e., a cover plate 32 and a main plate 40 bonded together by ultrasonic bonding. The main plate 40 is formed with an elongated recess portion 37 including orifices 34, pressure chambers 35, ink inlet passages 35*a*, an ink reservoir 36 and an ink supply passage 36*a* in the same manner as in the third preferred embodiment. Furthermore, a plurality of closed recesses 41, 42 and 43 are formed on the bonding surface of the main plate 40. More specifically, the closed recesses 41 are formed on the opposite outer sides of the elongated recess portion 37; each closed recess 42 is formed between the adjacent orifices 34; and each closed recess 43 is formed between the adjacent ink inlet passages 35*a*, in such a manner that the width of the bonding surface of the main plate 40 is made uniform.

In operation, the driving portions 19 of the piezoelectric member 28 of the main plate 40 are selectively expanded and contracted to thereby discharge an ink (not shown)contained in the pressure chambers 35 in the same manner as in the third preferred embodiment.

The plates 32 and 40 are manufactured by substantially the same method as that of the third preferred embodiment. In particular, the plates 32 and 40 are bonded together by ultrasonic bonding. Since the width of the bonding surface of the main plate 40 is made uniform by the recess portion 37 and the closed recesses 41 to 43, melting of the bonding surface by the ultrasonic bonding is uniformly effected. Accordingly, the main plate 40 can be well bonded to the cover plate 32 by the ultrasonic bonding without the necessity of formation of any edges on the bonding surface.

Further, the formation of the closed recesses 41 to 43 substantially means that the wall of the main plate 40 is cut out, which contributes to a reduction in weight of the main plate 40. Further, the closed recesses 41 to 43 may be communicated with the ink supply passage 36*a* or the ink reservoir 36. In this case, the closed recesses 41 to 43 can be utilized as an ink reservoir. While the closed recesses 41 to 43 are formed on the main plate 40 to contribute to the improvement in the productivity in the above preferred embodiment, the closed recesses 41 to 43 may be formed on the cover plate 32.

Figure 15:
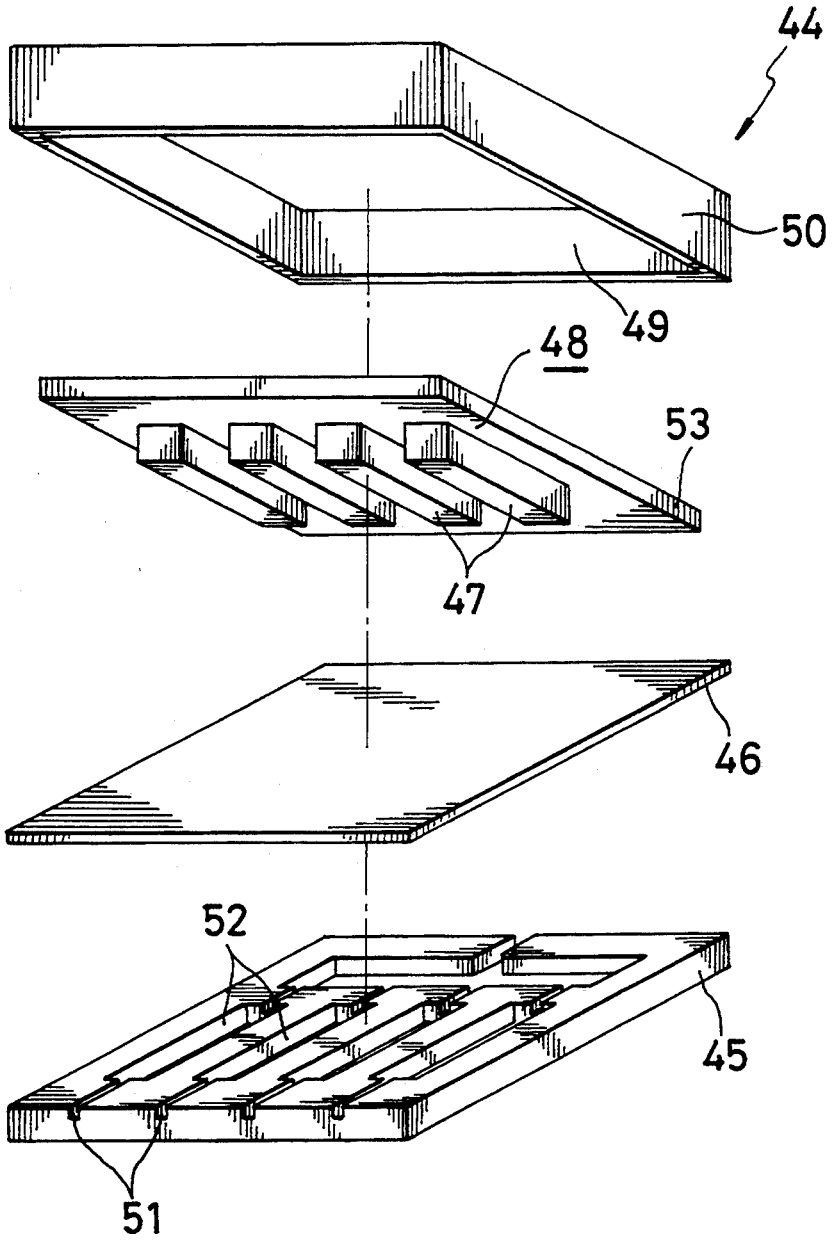
FIG. 15 is an exploded perspective view of the ink jet printer head according to the fifth preferred embodiment.
Figure 16:
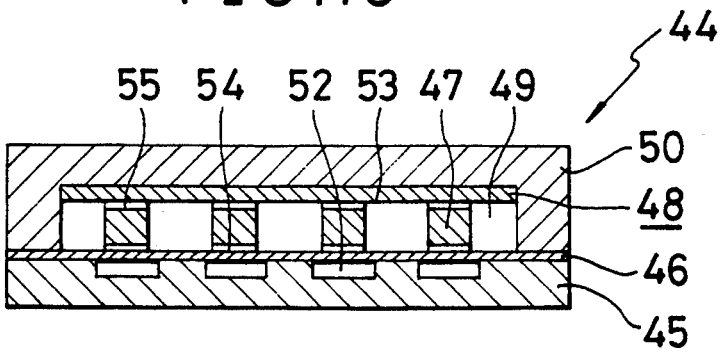
FIG. 16 is a vertical sectional view of the ink jet printer head shown in FIG. 15.

A fifth preferred embodiment of the present invention will be described with reference to FIGS. 14(*a*) to 21(*d*). The fifth preferred embodiment corresponds to the species as defined in claim 10. Referring to FIGS. 15 and 16, reference numeral 44 generally designates an ink jet printer head according to the fifth preferred embodiment. The ink jet printer head 44 is generally constructed of a channel plate 45 having a specifically recessed upper surface so as to form plural orifices 51, plural pressure chambers 52, plural ink inlet passages 52*a*, an ink reservoir 52*b* and an ink supply passage 52*c*, a thin elastic vibration plate 46 bonded to the upper surface of the channel plate 45, a comb-like pressure generating section 48 having a plurality of parallel driving portions 47 projecting from a lower surface thereof and disposed on an upper surface of the vibration plate 46, and a cover plate 50 having a recess 49 so as to fully cover the pressure generating section 48 and bonded at an outer peripheral portion thereof to the upper surface of the vibration plate 46. Thus, the orifices 51, the pressure chambers 52, the ink inlet passages 52*a*, the ink reservoir 52*b* and the ink supply passage 52*c* formed on the upper surface of the channel plate 45 are closed on their upper sides by the lower surface of the vibration plate 46. The lower end surfaces of the driving portions 47 of the pressure generating section 48 are in contact with the upper surface of the vibration plate 46 so as to be opposed through the vibration plate 46 to the pressure chambers 52 of the channel plate 45, respectively. Each driving portion 47 is formed of piezoelectric ceramic, and it is polarized in a projecting direction thereof, that is, in the vertical direction as viewed in FIG. 16. The pressure generating section 48 is constructed by bonding the driving portions 47 to an independent non-piezoelectric substrate 53. Further, as shown in FIG. 16, a pair of electrodes 54 and 55 are formed on the lower surface and the upper surface of each driving portion 47, respectively.

In operation, when a driving voltage is selectively applied between the electrodes 54 and 55, the driving portions 47 of the pressure generating section 48 are selectively expanded and contracted in the vertical direction. As a result, the contact portions of the vibration plate 46 with respect to the driving portions 47 are selectively displaced in the vertical direction to thereby apply pressure to an ink (not shown) contained in the corresponding pressure chambers 52 and discharge the pressurized ink from the corresponding orifices 51.

A manufacturing method for the pressure generating section 48 of the ink jet printer head 44 will be described with reference to FIGS. 14(*a*) to 14(*d*). In the case where the driving-portions 47 of the pressure generating section 48 are formed of PZT as an example of piezoelectric ceramic, a ceramic material composed of $TiO_2$, PbO, $ZrO_2$ and a characteristic modifier is mixed and dried. Then, the mixture is calcined, and it is further mixed with an organic binder and kneaded. Then, the mixture is pulverized to form a powder as a molding material. Then, injection molding of the powder is carried out. That is, the powder is heated to melt the organic binder contained therein, and is injected into a mold having a predetermined shape, thereby forming a comb-like molded body (green molded body). Then, the organic component in the molded body is vaporized in a degreasing oven, and the molded body is then baked (perfect sintering), thus forming a base member 57 as shown in FIG. 14(*a*). The base member 57 is integrally formed with the rectangular parallelepiped driving portions 47 projecting from the upper surface of a base portion 56 and extending parallel in a longitudinal direction of the base portion 56. Then, as shown in FIG. 14(*b*) the electrodes 55 are formed on the upper surfaces of the driving portions 47 by a known thin film technique. Then, as shown in FIG. 14(*c*), the base member 57 is vertical inverted from the condition shown in FIG. 14(*b*), and the driving portions 47 are bonded through the electrodes 55 to the upper surface of the non-piezoelectric substrate 53. Then, as shown in FIG. 14(*d*), the base portion 56 only is cut away from the driving portions 47 by grinding or dicing, so that the driving portions 47 only remain on the upper surface of the independent non-piezoelectric substrate 53, thus obtaining the comb-like pressure generating section 48.

Further, although not shown, the upper surfaces of the driving portions 47 as viewed in FIG. 14(*d*) are desirably finished by polishing or the like, and the other electrodes 54 are formed on the finished upper surfaces of the driving portions 47. Then, the pressure generating section 48 is immersed into a silicone oil, and an electric field of 2 to 5 KV/mm is applied between the electrodes 54 and 55 to thereby polarize the driving portions 47 in the projecting direction thereof. Further, the material of the driving portions 47 may be a three-component ceramic material containing a composite pervskite oxide added to the two-component PZT.

As mentioned above, the base member 57 of the pressure generating section 48 is formed by injection molding of piezoelectric ceramic, thereby greatly improving the productivity. The base member 57 has the uneven upper surface forming the driving portions 47 and has the flat lower surface. Accordingly, in baking the molded body, the base member 57 is apt to be curved. Accordingly, sizing of the base member 57 is carried out in bonding to the non-piezoelectric substrate 53, thereby greatly improving the form accuracy of the pressure generating section 48.

Further, since the driving portions 47 formed of piezoelectric ceramic are bonded to the independent non-piezoelectric substrate 53 to form the pressure generating section 48, there is no possibility that the piezoelectric substrate 53 will be deformed by the driving voltage to be applied to the driving portions 47. Therefore, the operational characteristics of the driving portions 47 can be improved, and the generation of cross talk can be prevented.

The channel plate 45 and the cover plate 50 may also be formed by injection molding of ceramic to improve the productivity, the form accuracy and the durability. Further, since the base member 57 is uniform in sectional shape, it may be formed by extrusion molding rather than injection molding.

Figure 17:
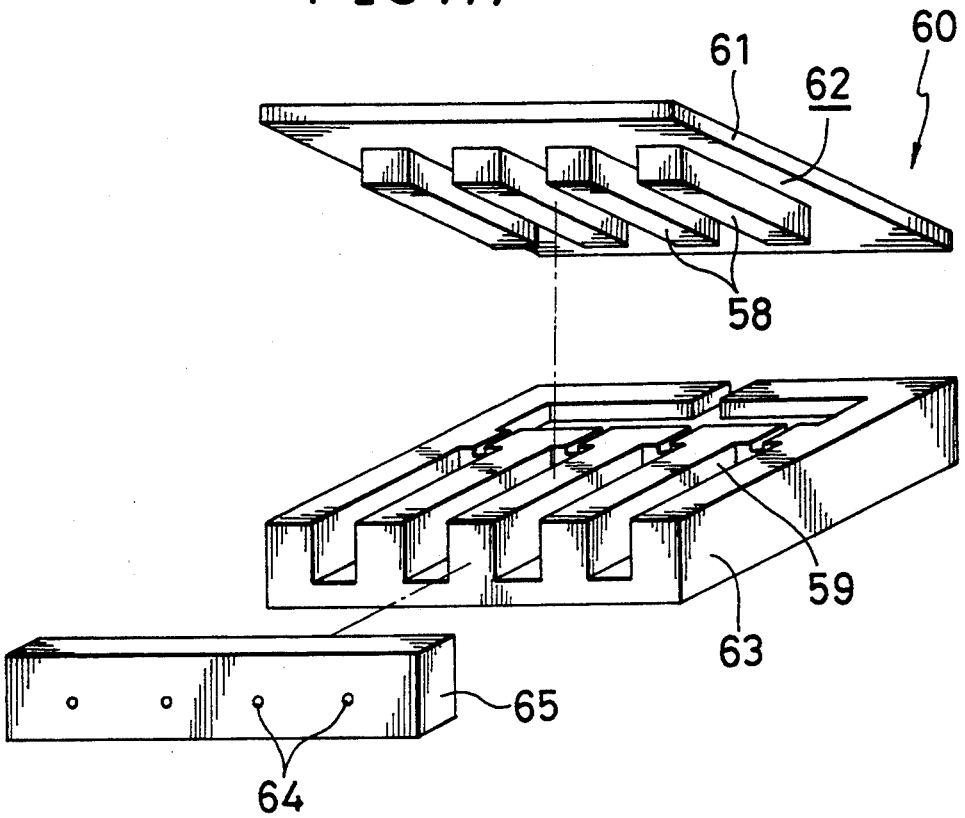
FIG. 17 is an exploded perspective view of an ink jet printer head according to a modification of the fifth preferred embodiment.
Figure 18:
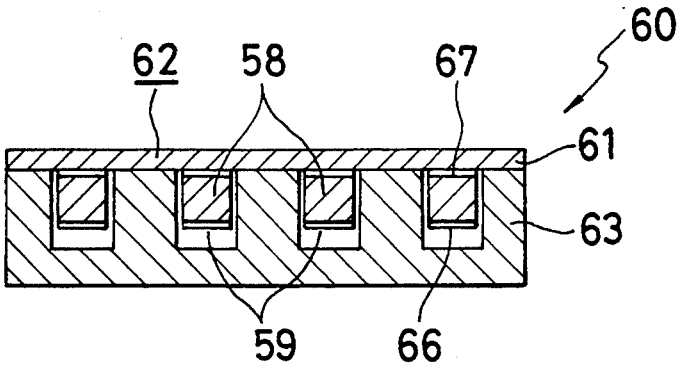
FIG. 18 is a vertical sectional view of the ink jet printer head shown in FIG. 17.

While the vibration plate 46 is interposed between the pressure generating section 48 and the channel plate 45 in the ink jet printer head 44 mentioned above, this construction is merely illustrative and various modifications may be made according to the present invention. An example of such modifications is shown in FIGS. 17 and 18, in which reference numeral 60 generally designates an ink jet printer head eliminating the above-mentioned vibration plate. That is, the ink jet printer head 60 is generally constructed of a channel plate 63, a pressure generating Section 62 bonded to an upper surface of the channel plate 63, and an orifice plate 65 bonded to a front surface of an assembly of the channel plate 63 and the pressure generating section 62 bonded together. The upper surface of the channel plate 63 is specifically recessed to form a plurality of pressure chambers 59, a plurality of ink inlet passages 59*a*, an ink reservoir 59*b* and an ink supply passage 59*c* communicating with each other. The pressure generating section 62 is constructed of a non-piezoelectric substrate 61 and a plurality of driving portions 58 bonded to a lower surface of the non-piezoelectric substrate 61. As shown in FIG. 18, the driving portions 58 of the pressure generating section 62 are received in the pressure chambers 59 of the channel plate 63, respectively. The orifice plate 65 is formed with a plurality of orifices 64 communicating with the pressure chambers 59 of the channel plate 63, respectively. Further, as shown in FIG. 18, a pair of electrodes 66 and 67 are formed on the lower surface and the upper surface of each driving portion 58 polarized in the vertical direction thereof. Accordingly, when a driving voltage is selectively applied between the electrodes 66 and 67 on the driving portions 58, the driving portions 58 are selectively expanded an contracted in the vertical direction to thereby discharge an ink (not shown) contained in the corresponding pressure chambers 59 from the corresponding orifices 64.

Figure 19:
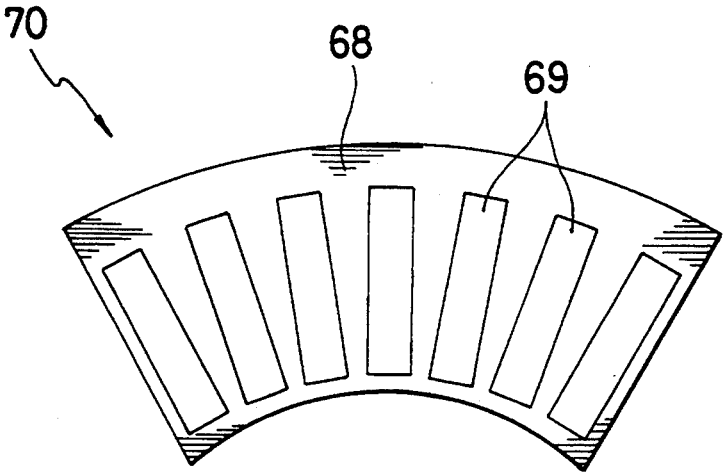
FIG. 19 is a plan view of a pressure generating section according to another modification of the fifth preferred embodiment.
Figure 20A:
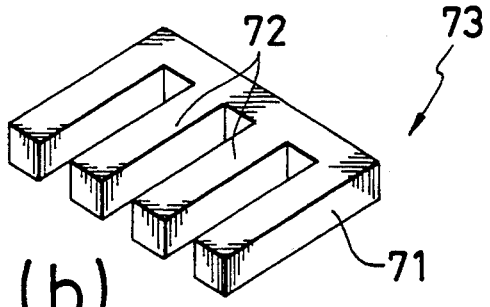
FIGS. 20(*a*) to 20(*d*) are perspective views illustrating a manufacturing method for a pressure generating section according to a further modification of the fifth preferred embodiment.
Figure 20B:
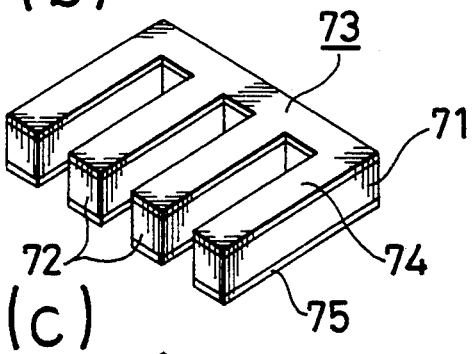
Figure 20C:
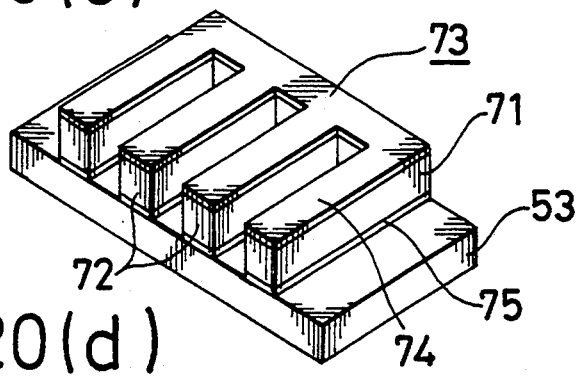
Figure 20D:
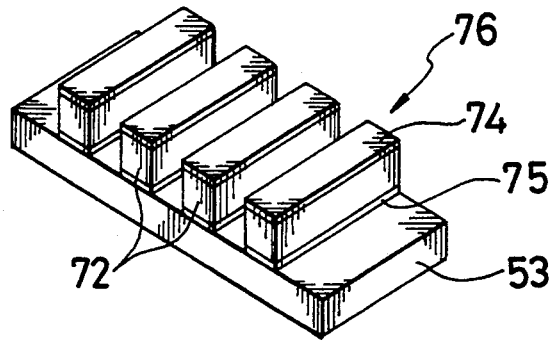
Figure 21A:
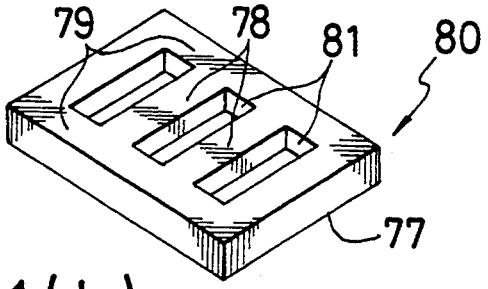
FIGS. 21(*a*) to 21(*d*) are perspective views illustrating a manufacturing method for a pressure generating section according to a still further modification of the fifth preferred embodiment.
Figure 21B:
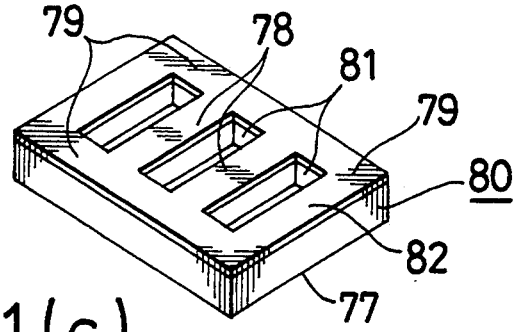
Figure 21C:
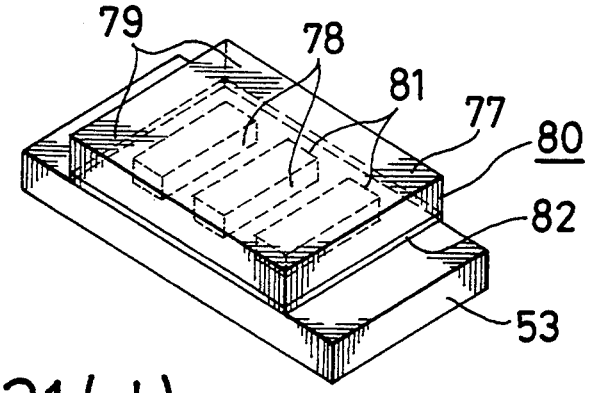
Figure 21D:
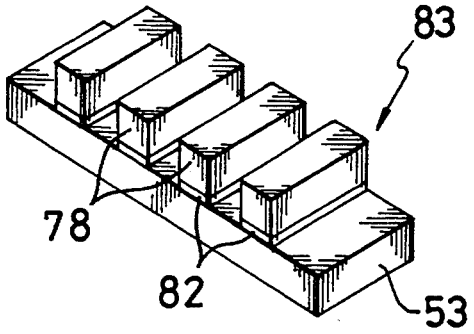
Figure 22A:
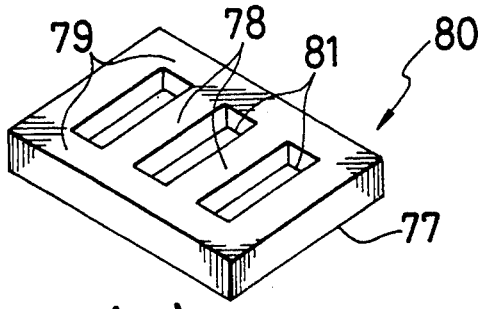
FIGS. 22(*a*) to 22(*d*) are perspective views illustrating a manufacturing method for a pressure generating section of an ink jet printer head according to a sixth preferred embodiment of the present invention.
Figure 22B:
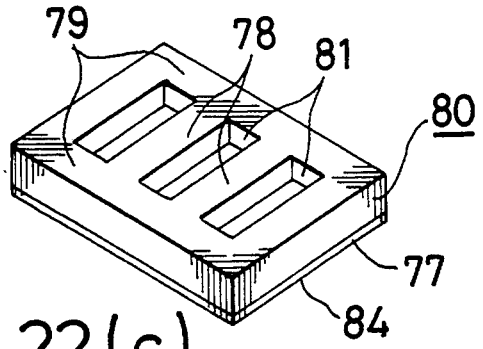
Figure 22C:
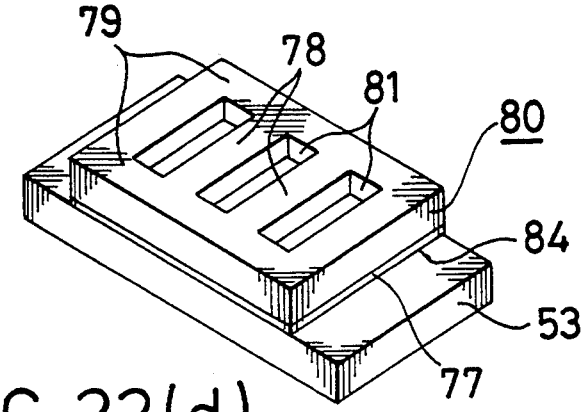
Figure 22D:
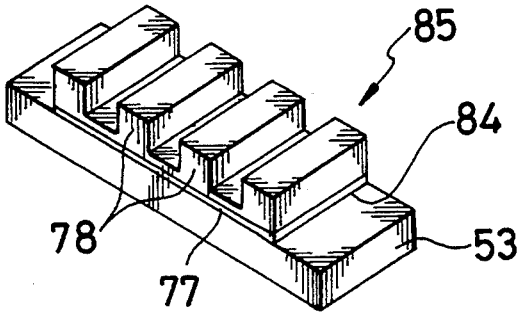
Figure 23:
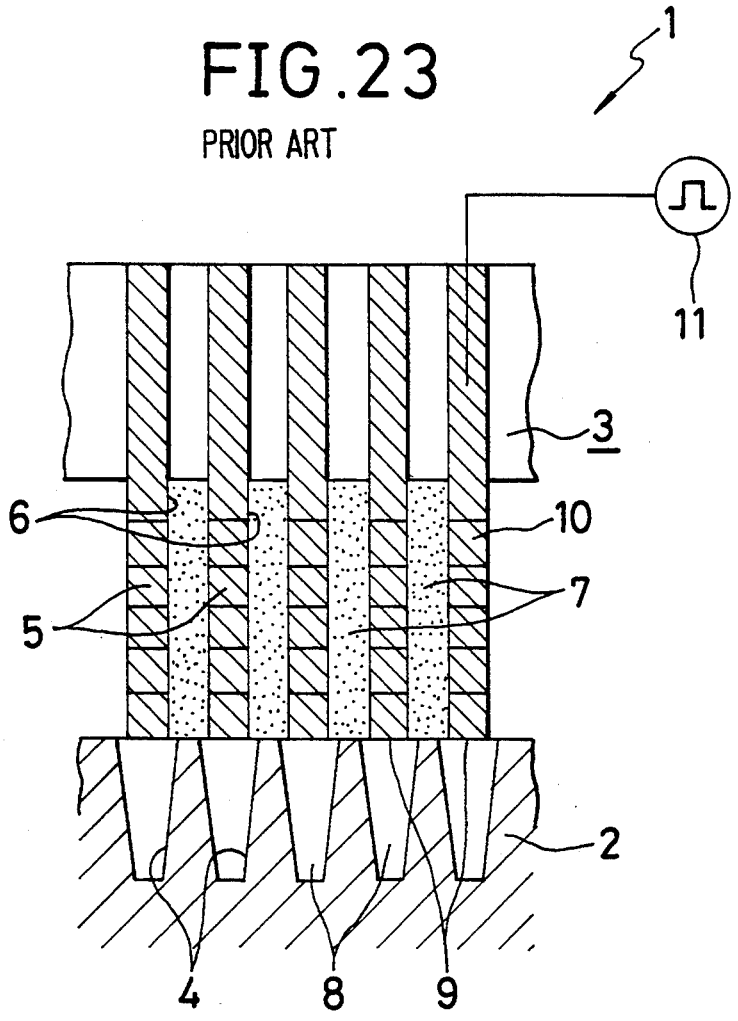
FIG.23 PRIOR ART
FIG. 23 is a vertical sectional view of an ink jet printer head in the prior art.

While the driving portions 47 or 58 in the ink jet printer head 44 or 60 are arranged in parallel to each other, and the pressure chambers 52 or 59 are also arranged in parallel to each other so as to be respectively opposed to the driving portions 47 or 58, this arrangement is merely illustrative and various modifications may be made according to the present invention. An example of such modifications is shown in FIG. 19. That is, a plurality of driving portions 69 are radially arranged on an arcuate non-piezoelectric substrate 68 to form an arcuate pressure generating section 70. Although not shown, a plurality of pressure chambers are also arranged radially so as to be respectively opposed to the driving portions 69, and a plurality of orifices are arranged on an inner circumference of the arcuate pressure generating section 70. Thus, the density of arrangement of the orifices is made higher than that of the driving portions 69 and the pressure chambers. Further, a base member (not shown) to be formed into the driving portions 69 of the pressure generating section 70 is not uniform in sectional shape. Therefore, the base member cannot be formed by injection molding, but may be formed by extrusion molding.

The manufacturing method for the pressure generating section 48, 62 or 70 mentioned above is merely illustrative and various modifications may be made according to the present invention. An example of such modifications is shown in FIGS. 20(*a*) to 2(*d*).

Referring first to FIG. 20(*a*), a base member 73 is integrally formed by injection molding or extrusion molding of piezoelectric ceramic. The base member 73 is composed of a laterally elongated base portion 71 and a plurality of longitudinally elongated driving portions 72 projecting from a front surface of the base portion 71. Then, as shown in FIG. 20(*b*), a pair of electrodes 74 and 75 are formed on upper and lower surfaces of the base member 73. Then, as shown in FIG. 20(*c*), the base member 73 is bonded through the electrode 75 to an upper surface of a non-piezoelectric substrate 53. Then, as shown in FIG. 20(*d*), the base portion 71 only is cut away from the driving portions 72 by grinding or dicing, so that the driving portions 72 only remain on the upper surface of the non-piezoelectric substrate 53 to thereby obtain a pressure generating section 76.

As similar to the base member 57 as mentioned above with reference to FIGS. 14(*a*) to 14(*d*), the comb-like base member 73 has the uneven front surface forming the driving portions 72 and has the flat rear surface. Accordingly, in baking the molded body, the base member 73 is apt to be curved. Accordingly, sizing of the base member 73 must be carried out in bonding to the non-piezoelectric substrate 53.

The necessity of such sizing can be eliminated by the method as shown in FIGS. 21(*a*) to 21(*d*). Referring first to FIG. 21(*a*), a base member 80 is integrally formed by injection molding of piezoelectric ceramic. The base member 80 is composed of a thin plate-like base portion 77, a plurality of longitudinally elongated driving portions 78 projecting from an upper surface of the base portion 77, and a pair of laterally elongated reinforcing portions 79 projecting from the upper surface of the base portion 77 so as to connect the driving portions 78 at the front and rear ends thereof. With this arrangement, a plurality of longitudinally elongated recesses 81 are formed on an upper surface of the base member 80 between the driving portions 78. Then, as shown in FIG. 21(*b*), an electrode 82 is formed on the upper surface of the base member 80, that is, the upper surfaces of the driving portions 78 and the reinforcing portions 79. Then, as shown in FIG. 21(*c*) the base member 80 is vertically inverted from the condition shown in FIG. 21(*b*), and is bonded through the electrode 82 to an upper surface of a non-piezoelectric substrate 53. Then, as shown in FIG. 21(*d*), the base portion 77 and the reinforcing portions 79 are cut away from the driving portions 78 by grinding or dicing, so that the driving portions 78 only remain on the upper surface of the non-piezoelectric substrate 53 to thereby obtain a pressure generating section 83.

In the pressure generating section 76 or 83, the driving portions 72 or 78 are bonded to the independent non-piezoelectric substrate 83. Therefore, there is no possibility of deformation of the non-piezoelectric substrate 53 due to a driving voltage applied to the driving portions 72 or 78, thereby improving the operational characteristics of the driving portions 72 or 78 and preventing the generation of cross talk in an ink jet printer head (not shown) employing the pressure generating section 76 or 83. Furthermore, the base member 80 for the pressure generating section 83 has such a structure that the driving portions 78 are connected at their front and rear ends to the reinforcing portions 79. Therefore, the strength of the base member 80 can be ensured in spite of the small thickness of the base portion 77, thereby preventing the deformation of the base member 80 in baking of the molded body. Accordingly, it is unnecessary to carry out sizing of the base member 80 in bonding to the non-piezoelectric substrate 53.

A sixth preferred embodiment of the present invention as a modification of the above method shown in FIGS. 21(*a*) to 21(*d*) will be described with reference to FIGS. 22(*a*) to 22(*d*), in which the same parts as those in FIGS. 21(*a*) to 21(*d*) are designated by the same reference numerals. The sixth preferred embodiment corresponds to the species as defined in claim 11. Referring first to FIG. 22(*a*), a base member 80 is integrally formed by injection molding of piezoelectric ceramic in the same manner as in FIG. 21(*a*), That is, the base member 80 shown in FIG. 22(*a*) is the same as that shown in FIG. 21(*a*). Then, as shown in FIG. 22(*b*), an electrode 84 is formed on the lower surface of the base member 80, that is, the lower surface of the base portion 77. Then, as shown in FIG. 22(*c*), he base member 80 is bonded through the electrode 84 to an upper surface of a non-piezoelectric substrate 53. Then, as shown in FIG. 22(*d*) the reinforcing portions 79 only are cut away from the driving portions 78 and the base portion 77 by grinding or dicing, so that the driving portions 78 and the base portion 77 integrally connected thereto remain on the non-piezoelectric substrate 53.

With this arrangement, the driving portions 78 integrally connected at their bottom portions to the base portion 77 are bonded to the independent non-piezoelectric substrate 53. However, since the thickness of the base portion 77 is very small, the cross talk can be very reduced to such an extent that no problem occurs in practical use. Further, since the base member 80 has such a structure that the driving portions 78 are connected at their front and rear ends to the reinforcing portions 79, the strength of the base member 80 can be ensured in spite of the small thickness of the base portion 77, thereby preventing the deformation of the base member 80 in baking of the molded body. Accordingly, it is unnecessary to carry out sizing of the base member 80 in bonding to the non-piezoelectric substrate 53, thus contributing to the improvement in the productivity of an ink jet printer head (not shown) employing the pressure generating section 85.

Further, it is to be noted that the molding termed in the present invention means either injection molding or extrusion molding, and it excludes press working or the like.

What is claimed is:

1. An ink jet printer head comprising:

a pair of first and second body plates having bonding surfaces bonded to each other;

a recess portion formed on at least one of the bonding surfaces of said first and second body plates, said recess portion comprising an ink supply passage, a plurality of pressure chambers communicating with said ink supply passage, and a plurality of orifices respectively communicating with said pressure chambers;

a pressure generating section having a plurality of driving portions formed from a piezoelectric member, said driving portions having pressure applying surfaces respectively opposed to said pressure chambers;

a resin member molded with said pressure generating section inserted therein which is connected to at least one of said first and second body plates, said resin member also being positioned between said driving portions;

said piezoelectric member having an upper and lower surface; and at least one of said upper and lower surfaces having a conductive film formed thereon.

2. The ink jet printer head as defined in claim 1, wherein said resin member is readily deformable with said driving portions.

3. The ink jet printer head as defined in claim 1, wherein said recess portion is formed on said bonding surface of said first body plate; said pressure generating section and said resin member are provided in said second body plate; and said driving portions are grouped such that each group comprises a plurality of first driving portions having said pressure applying surfaces respectively opposed to said pressure chambers and a second driving portion not having said pressure applying surfaces, said second driving portion being located between adjacent driving portions of said first driving portions.

4. The ink jet printer head as defined in claim 1, wherein said recess portion is formed on said bonding surface of said first body plate; said pressure generating section and said resin member are provided in said first body plate so as to expose said driving portions of said pressure generating section to said pressure chambers of said recess portion; and said bonding surface of said second body plate is flat.

5. The ink jet printer head as defined in claim 4, wherein said resin member has a hardness characteristic such that no pressure loss in said pressure chambers occurs.

6. The ink jet printer head as defined in claim 1, further comprising a second recess portion formed on said bonding surface of at least one of said first and second body plates, wherein said bonding surfaces of said first and second body plates are ultrasonically bonded to each other.

7. The ink jet printer head as defined in claim 6, wherein said second recess portion comprises an ink reservoir.

8. An ink jet print head as defined in claim 1, manufactured by a method comprising the steps of:

bonding said piezoelectric member to an upper surface of an insulating substrate, said conductive film being formed on both said upper and lower surfaces of said piezoelectric member;

cutting said piezoelectric member and said conductive film formed on both said upper and lower surface to form said driving portions from said piezoelectric member and form first and second electrodes from said conductive film formed on both said upper and lower surface, respectively;

molding said resin member with said pressure generating section inserted therein such that said pressure applying surfaces of said driving portions are exposed along an outer edge of said resin member; and bonding said bonding surface of said first body plate to said bonding surface of said second body plate.

9. An ink jet printer head as defined in claim 5, comprising the steps of:

bonding said piezoelectric member to an upper surface of an insulating substrate, said conductive film being formed on said upper and lower surfaces of said piezoelectric member;

cutting said piezoelectric member and said conductive film formed on both said upper and lower surface to form said driving portions from said piezoelectric member and form first and second electrodes from said conductive film formed on both said upper and lower surface, respectively;

molding said resin member with said pressure generating section inserted therein so as to expose said pressure applying surfaces of said driving portions to said pressure chambers of said recess portion; and bonding said flat bonding surface of said second body plate to said bonding surface of said first body plate.

* * * * *